United States Patent [19]

Ohkumo et al.

[11] Patent Number: 5,002,026

[45] Date of Patent: Mar. 26, 1991

[54] ENGINE IDLE SPEED CONTROL APPARATUS

[75] Inventors: Hiroya Ohkumo; Shuji Miyama, both of Tokyo, Japan

[73] Assignee: Fuji Jukogyo Kabushiki Kaisha, Tokyo, Japan

[21] Appl. No.: 524,445

[22] Filed: May 17, 1990

[30] Foreign Application Priority Data

May 18, 1989 [JP] Japan ..... 1-125139

[51] Int. Cl.[5] ..... R02M 3/08

[52] U.S. Cl. ..... 123/339; 123/585

[58] Field of Search ..... 123/339, 585, 588, 587, 123/340, 352; 364/431.07

[56] References Cited

U.S. PATENT DOCUMENTS 4,825,829 5/1989 Abe ..... 123/339

4,827,885 5/1989 Nishikawa et al. ..... 123/339

4,879,982 11/1989 Itakura et al. ..... 123/339

*Primary Examiner*—Raymond A. Nelli

*Attorney, Agent, or Firm*—Beveridge, DeGrandi & Weilacher

[57] ABSTRACT

An idle speed control apparatus of an engine, having a valve for changing an intake air quality to the engine, a device for measuring an engine coolant temperature, a circuit for detecting an engine speed, and a device responsive to said engine speed for controlling an opening degree of said valve to maintain said engine speed to a predetermined speed under idling state, comprising: a device for producing a signal when said engine coolant temperature exceeds a predetermined temperature; a device responsive to said signal for starting to count a cumulative time period; a device responsive to said cumulative time period for setting a correction opening degree; and a device responsive to said correction opening degree and a current opening degree of said valve means for calculating a learnt opening degree.

7 Claims, 6 Drawing Sheets

ENGINE IDLE SPEED CONTROL APPARATUS

BACKGROUND OF THE INVENTION

The present invention relates to an engine idle speed control apparatus for controlling an engine idle speed by an idle control valve bypassing a throttle valve mounted on a vehicle engine, and more particularly to a control system for controlling an opening degree of the idle control valve in dependency on temperature of lubricating oil.

A conventional engine idle speed control apparatus controls the idle speed at a very low speed (e.g., 800 rpm) so that an influence of oil friction by viscosity is substantially large. It is therefore necessary to control the opening degree of an idle control valve due to the influence of the oil friction.

In view of this, there has been proposed a method of correcting the idle speed under a cool state as disclosed, e.g., in Japanese Patent Laid-open Publication No. 55-5441. According to this prior art, the opening degree of an idle control valve and the bypassing air amount are corrected in accordance with the engine coolant temperature, thereby to maintain the idle speed to constant.

In this method, the opening degree of the idle control valve is directly controlled by the coolant temperature so that the influence of oil friction cannot be eliminated reliably. Namely, even if the coolant temperature enters a warmed-up state, the viscosity of lubricating oil is still high because the oil temperature rises slower than the coolant temperature. Accordingly, the opening degree of the idle control valve which is controlled by the coolant temperature, is unnecessarily reduced resulting in lowering the engine speed or in an engine stop. Further, in the case where a learning of the opening degree of the idle control valve is performed, a learnt opening degree is largely varied according to the variation of the oil temperature so that controllability of the learning is lowered.

It is therefore necessary to consider further the oil temperature and viscosity for the control of the opening degree of the idle control valve. It can be thought of using an oil temperature sensor. However, this leads to a rise in cost and a correct temperature is hard to be detected. In consideration of the above, the oil temperature may be estimated from the coolant temperature which directly influences the former. In this case, it is preferable to use a relation between the oil temperature and the cumulative period of time while the coolant temperature is equal to or higher than a preset coolant temperature.

SUMMARY OF THE INVENTION

The present invention has been made in consideration of the above circumstances. It is therefore an object of the present invention to provide an engine idle speed control apparatus capable of reliably estimating the oil temperature condition on the basis of a coolant temperature and precisely controlling the engine idle speed.

In order to achieve the above object, the present invention provides an idle speed control apparatus of an engine, having valve means for changing an intake air quality to the engine, means for measuring an engine coolant temperature, means for detecting an engine speed, and means responsive to said engine speed for controlling an opening degree of said valve means to maintain said engine speed to a predetermined speed under idling state, comprising: means for producing a signal when said engine coolant temperature exceeds a predetermined temperature; means responsive to said signal for starting to count a cumulative time period; means responsive to said cumulative time period for setting a correction opening degree; and means responsive to said correction opening degree and a current opening degree of said valve means for calculating a learnt opening degree.

With the engine idle speed control apparatus constructed as above, in controlling the opening degree of a throttle valve or an idle control valve to thereby regulate the engine idle speed, the degree of oil friction influence can be controlled correctly in accordance with the cumulative period of time while the engine is operated at a temperature equal to or higher than a predetermined coolant temperature. The correction opening degree specific to a particular oil temperature is used for the correction of the fixed or learnt opening degree, so that the engine idle speed can be corrected properly without any problem such as lowering an engine speed due to unexpected friction.

DETAILED DESCRIPTION OF THE PREFERRED EMBODIMENTS

The embodiment of this invention will be described with reference to the accompanying drawings.

Figure 1:
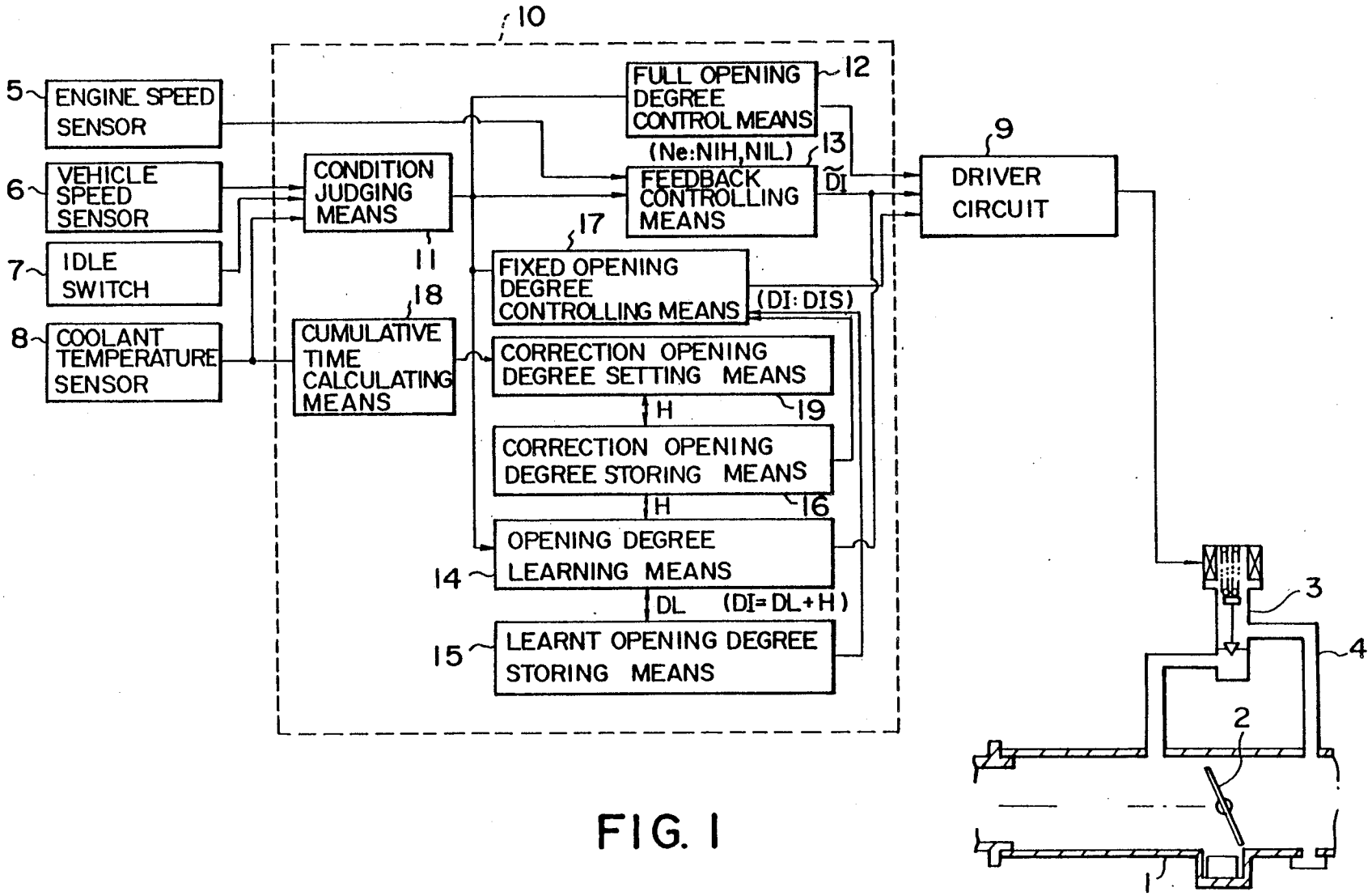
FIG. 1 is a schematic diagram showing an embodiment of an engine idle speed control apparatus according to the present invention.

Referring to FIG. 1, reference numeral 1 represents a throttle body of an engine intake air system. A throttle valve 2 is mounted within the throttle body 1. A conduit 4 having an idle control valve 3 is provided which bypasses the throttle valve 2. The opening degree of the idle control valve 3 is controlled in accordance with a signal from a control unit 10.

Supplied to the control unit 10 are signals from an engine speed sensor 5, a vehicle speed sensor 6, an idle switch 7, and a coolant temperature sensor 8. The signals from the vehicle speed sensor 6, the idle switch 7, and the coolant temperature sensor 8 are inputted to a condition judging means 11 of the control unit 10 for discriminating the condition such as acceleration running, coasting or idling under cool or warmed-up state of an engine E. During acceleration running, an opening degree signal from full opening degree controlling means 12 is outputted to the idle control valve 3 via a drive circuit 9 to thereby fully open the idle control valve 3. During the idling under the warmed-up state, feedback controlling means 13 outputs an opening degree signal which makes the engine speed indicated by the engine speed sensor 5 follow a predetermined idle speed. At this time, the opening degree signal is inputted to opening degree learning means 14 which makes a learning of $DI=DL+H$ where DL is a learnt opening degree from learnt opening degree storing means 15, and H is a correction opening degree from correction opening degree storing means 16. During the idling under the cool state and during the coasting, fixed opening degree controlling means 17 obtains a fixed opening degree DIS by using the learnt opening degree DL and the correction opening degree H and outputs an opening degree signal which makes DI=DIS.

Figure 2:
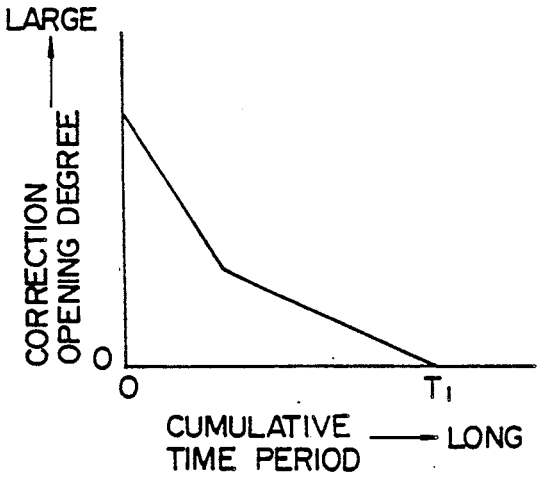
FIG. 2 is a graph showing a relationship between an oil temperature and a correction opening degree of an idle speed control valve.

A signal from the coolant temperature sensor 8 is inputted to cumulative time period calculating means 18 which calculates a cumulative time period T while the coolant temperature sensor 8 indicates a predetermined coolant temperature (e.g., 70° C.) or higher. The cumulative time period T is inputted to correction opening degree setting means 19. If the cumulative time period T is short, the temperature of lubricating oil is presumed low so that the correction opening degree H is required to be high. If the cumulative time period T is long, it is presumed that the oil temperature has risen so that the correction opening degree H is required to be decreased. The correction opening degree H is set as shown in FIG. 2 by way of example, relative to the cumulative time period T. The correction opening degree H is updated reference to the map of FIG. 2 irrespective of circumferential conditions and stored in the correction opening degree storing means 16.

The operation of the idle speed control apparatus as constructed above will be described with reference to the flow charts shown in FIGS. 3(*a*) to 3(*f*).

Figure 3A:
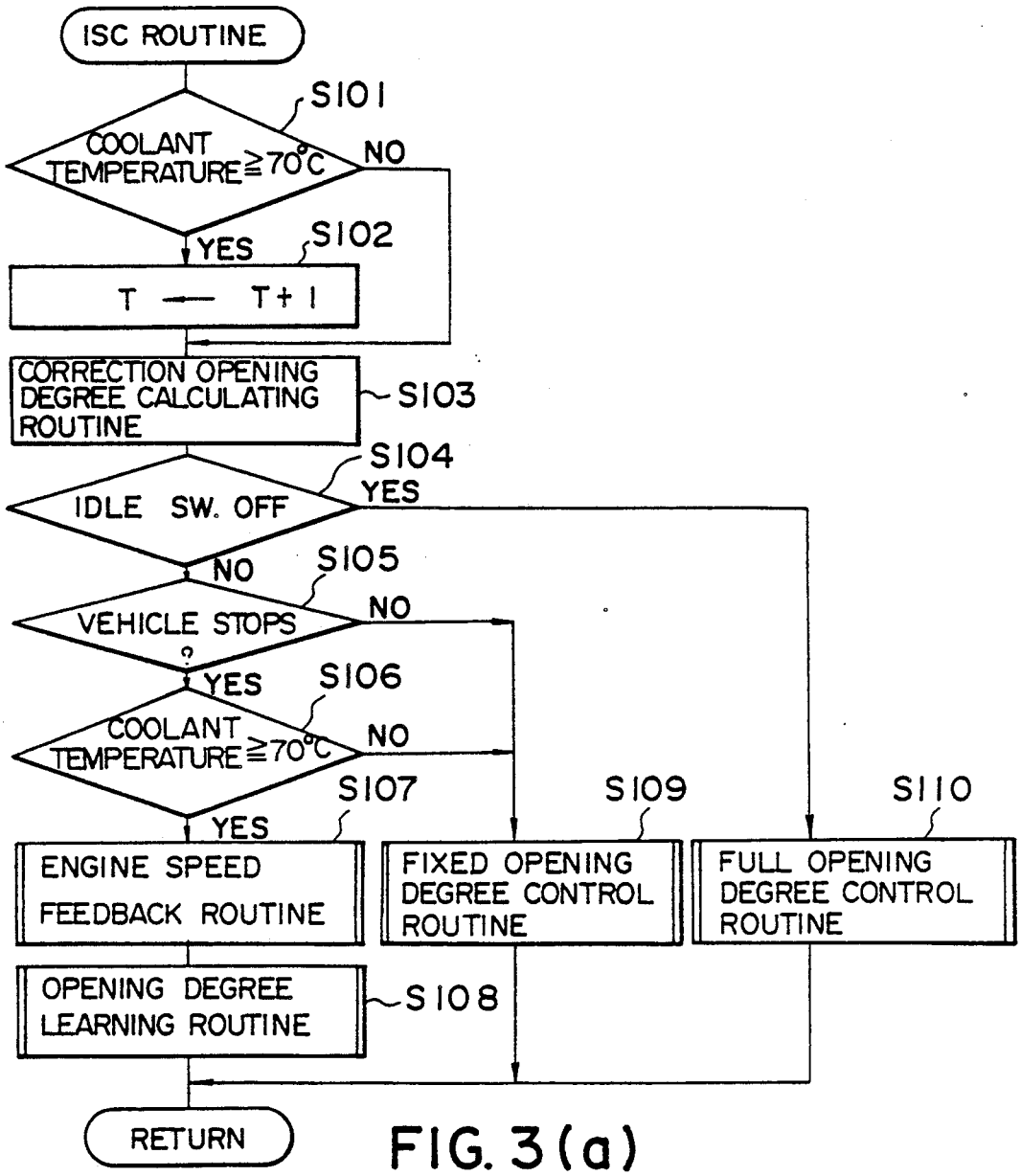
FIGS. 3(*a*) to 3(*f*) are flow charts illustrating control routines executed by the apparatus.
Figure 3B:
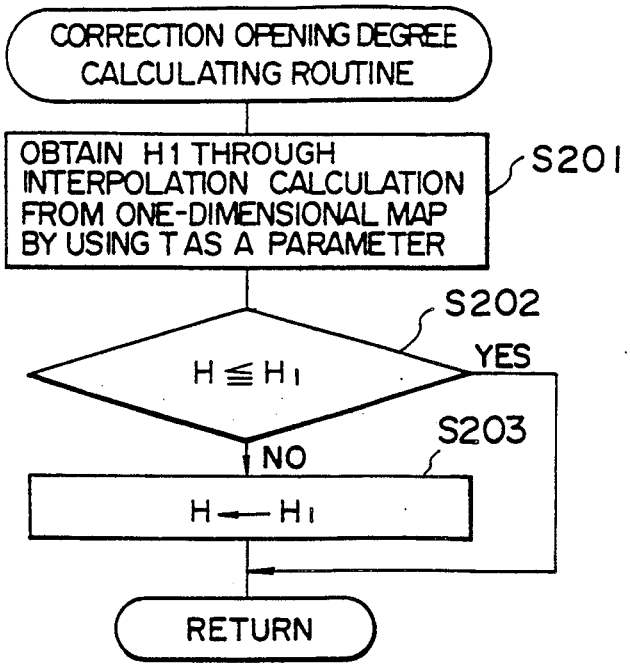
Figure 3C:
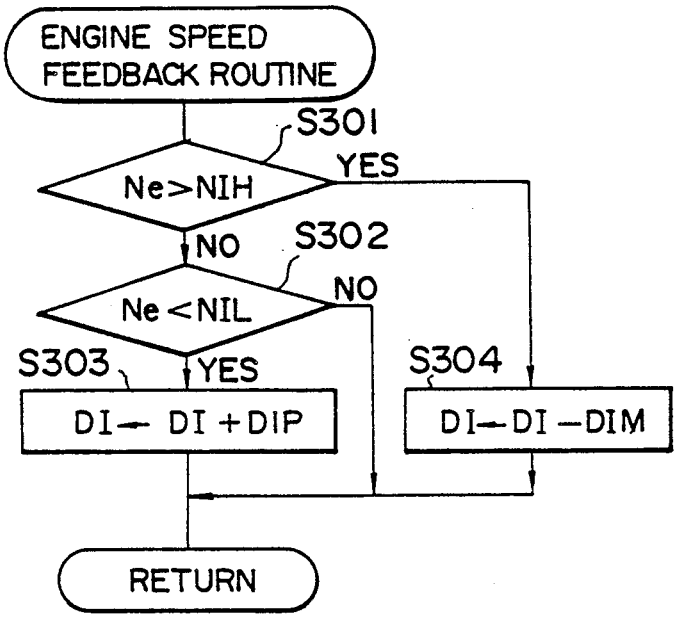
Figure 3D:
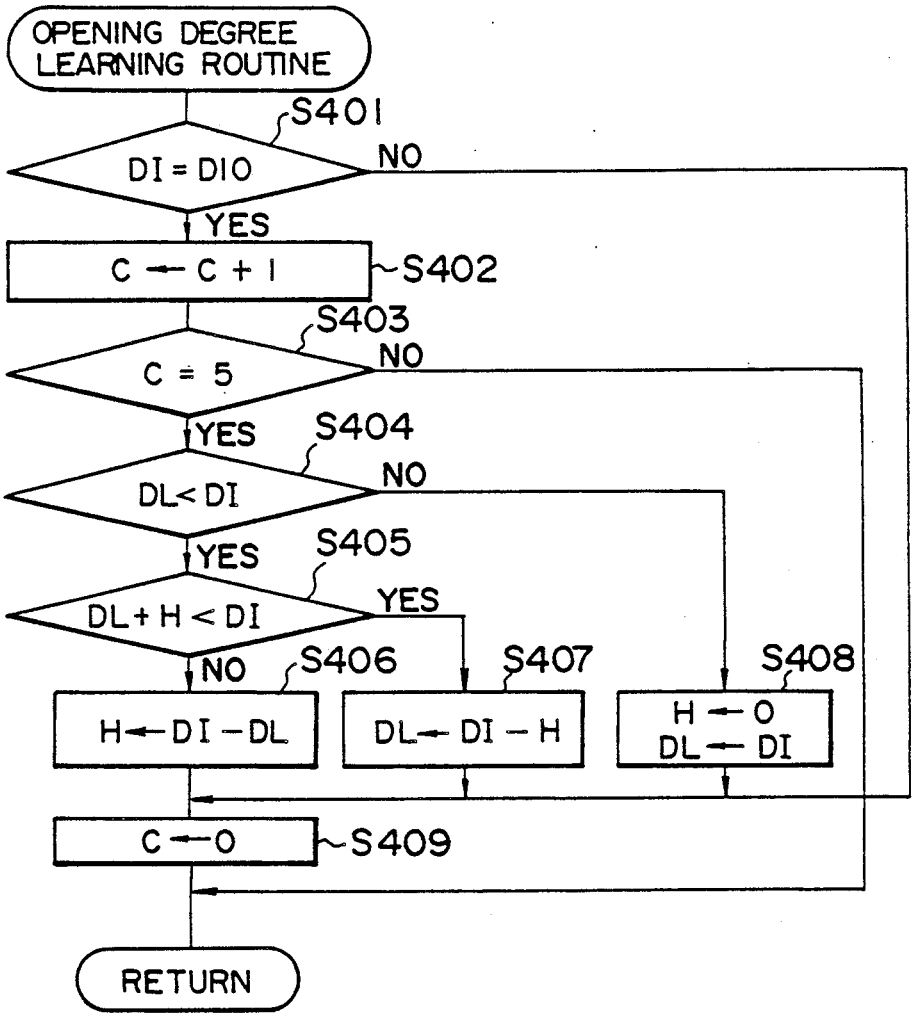
Figure 3:
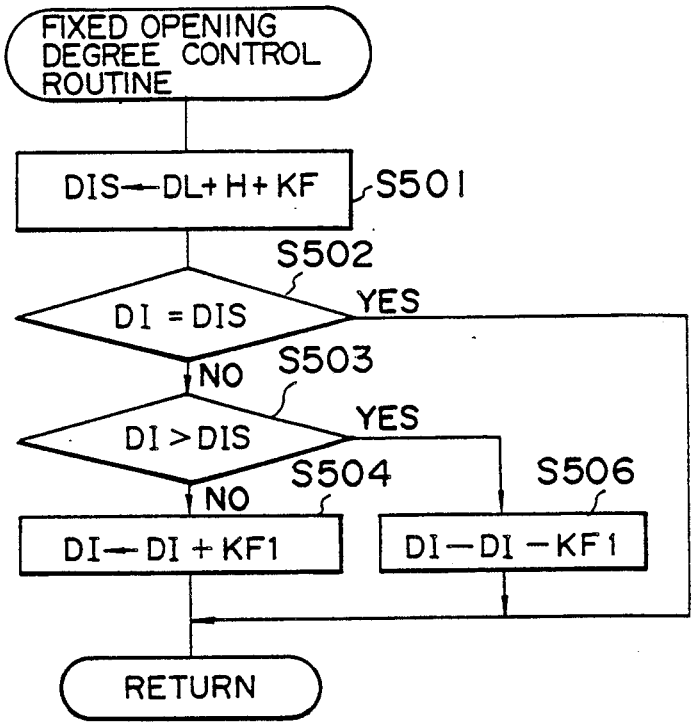
Figure 3:
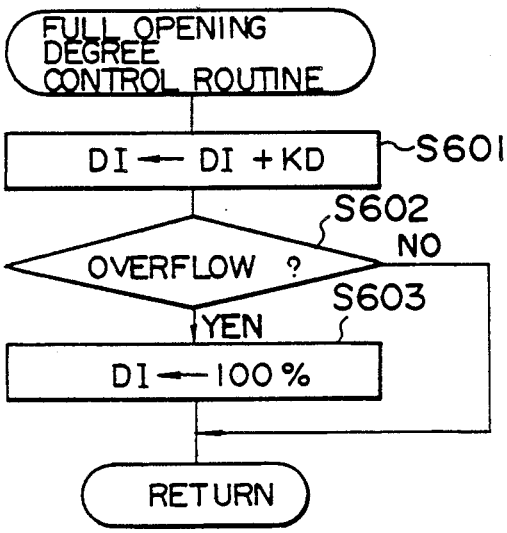

First, a routine shown in FIG. 3(*a*) is executed which is called from a main routine at an equal time interval. Specifically, at a step S101 the coolant temperature is checked. If the coolant temperature is a preset coolant temperature (70° C.) or higher, the cumulative time period T is incremented by a predetermined amount at a step S102 to measure the period T at that time. Thereafter, a correction opening degree calculating routine is executed at a step S103.

In the correction opening degree calculating routine shown in FIG. 3(*b*), a correction opening degree H1 is obtained at a step S201, by means of an interpolation calculation, from the one-dimensional map shown in FIG. 2 which shows the predetermined correction opening degree H by using the cumulative time period T as a parameter. When the coolant temperature is lower than the preset coolant temperature at the step S101, i.e., engine cool state, the correction opening degree H is always set to the maximum value because of T=0. Next, at a step S202 the current correction opening degree H is compared with the obtained opening degree H1. If H1<H, the correction opening degree is updated from H to H1 at a step S203. Contrarily, the correction opening degree is not updated when H1≧H. The correction opening degree H is initialized to a predetermined value every time when an ignition switch of a motor vehicle is turned on. Accordingly, upon entering the warmed-up state after an engine start, the correction opening degree H is set large while the cumulative time period T is short. As the cumulative time period T becomes long and the oil temperature rise is presumed, the correction opening degree H is gradually made low. Further, when a predetermined cumulative time period T1 is lapsed, the oil temperature is presumed as sufficiently high so that the correction opening degree H is made zero. Calculating the correction opening degree H is performed not only during an idle state but also during the running.

Next, the idle switch 7 is checked at a step S104 shown in FIG. 3(*a*). During the acceleration running or a steady running with the idle switch 7 being turned off, a full opening degree control routine shown in FIG. 3(*f*) starts at a step S110. Specifically, at a step S601, the opening degree DI of the idle control valve 3 is added with a predetermined value KD. An overflow is checked at a step S602. If an overflow occurs, the idle control valve 3 is set at the opening degree of 100% at a step S603 and fixed to its full-open state.

If the idle switch 7 takes an on-state at the step S104 of FIG. 3(*a*), the flow advances to a step S105 whereat the vehicle speed is checked. If the vehicle is being stopped, the coolant temperature is checked at a step S106. If the vehicle is not being stopped, that is, during coasting, and the coolant temperature is lower than the predetermined coolant temperature, that is, during idling under cool state, then the flow advances to step S109 to execute a fixed opening degree routine shown in FIG. 3(*e*). Specifically, the fixed opening degree DIS is calculated at a step S501 by adding together the learnt opening degree DL, the correction opening degree H, and a predetermined value KF. In the case where learning of the opening degree is not performed after engine start, the learnt opening degree DL which was learnt during previous engine operation is used for calculating the fixed opening degree DIS. The fixed opening degree DIS is compared at a step S502 with the current opening degree DI of the idle control valve 3. If DIS<DI, then the opening degree DI is updated by subtracting a predetermined value KF1 from the current opening degree DI at a step S506. If DIS>DI, then the opening degree DI is updated by adding the predetermined value KF1 to the current opening degree at a step S504. In the above manner, the opening degree DI of the idle control valve 3 is controlled to converge into the fixed opening degree DIS. The correction opening degree H changes with the oil temperature so that as described previously, the opening degree DI of the idle control valve 3 during the coasting or idling under cool state becomes small as the oil temperature rises.

During idling under warmed-up state, the flow advances from the step S106 to a step S107 shown in FIG. 3(*a*) to execute an engine speed feedback routine shown in FIG. 3(*c*) and thereafter execute an opening degree learning routine shown in FIG. 3(*d*). At a step S301 in the engine speed feedback routine shown in FIG. 3(*c*), the engine speed Ne is compared with a desired upper limit NIH. If Ne>NIH, a predetermined value DIM is subtracted from the opening degree DI of the idle control valve 3 at a step S304. If the engine speed is lower than a desired lower limit NIL at a step S302, then the flow advances to a step S303 whereat a predetermined value DIP is added to the opening degree DI of the idle control valve 3. In this manner, the opening degree DI of the idle control valve 3 is feedback controlled so that the engine speed Ne converges between the desired upper and lower limits NIH and NIL irrespective of the influence of oil friction at any temperature.

Figure 4:
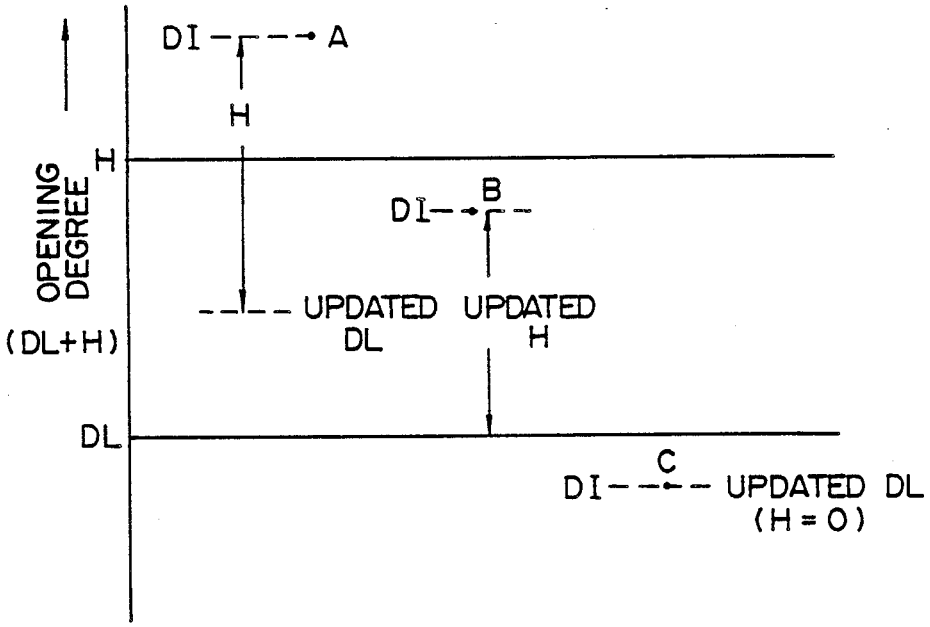
FIG. 4 is a diagram illustrating how the learnt opening degree is corrected.

In the opening degree learning routine shown in FIG. 3(*d*), the opening degree DI of the idle control valve 3 is learnt during the idle speed feedback control. Particularly, at a step S401 the opening degree DI of the idle control valve 3 is compared with the previous opening degree DIO. When the opening degree DI converges into a predetermined range (between NIL and NIH) by the engine speed feedback control and becomes equal to the previous opening degree, a learning counter C is incremented by "1". If a predetermined number of counts (e.g., 5 counts) has been counted at a step S403, it is judged that a learning condition has been satisfied for a steady idle state. At a step S404 the learnt opening degree DL is compared with the opening degree DI of the idle control valve 3. If DL>DI as exemplarily indicated at point C in FIG. 4, the correction opening degree H is set to 0 at a step S408 and the opening degree DI is updated to the learnt opening degree DL. If DL<DI, it means that the opening degree DI is larger than the learnt opening degree DL by the amount of the correction opening degree H. Therefore, at a step S405 the sum of the learnt opening degree DL and the correction opening degree H is compared with the opening degree DI. If DL+H<DI as exemplarily indicated at point A in FIG. 4, at a step S407 the correction opening degree H is not updated, but the learnt opening degree DL is updated so that the sum of the learnt opening degree DL and the correction opening degree H becomes the opening degree DI. If DL+H>DI as exemplarily indicated at point B in FIG. 4, at a step S406 the learnt opening degree DL is not updated, but the correction opening degree H is updated so that the sum of the learnt opening degree DL and the correction opening degree H becomes the opening degree DI. In the above manner, the learnt opening degree or the correction opening degree is updated while always retaining the relationship that the sum of the learnt opening degree DL and the correction opening degree H becomes equal to the opening degree DI of the idle control valve 3. Consequently, if the oil temperature is low and the correction opening degree H is large, the learnt opening degree DL becomes large. To the contrary, the learnt opening degree DL is updated to the opening degree DI after the correction opening degree H has become zero as well as the oil temperature becomes high.

The learnt opening degree DL and the correction opening degree H are used for obtaining the fixed opening degree DIS for the fixed opening degree control during the idling under cool state, to thereby allow a fast idle control.

The above-described embodiment of this invention has been directed to the idle speed control for the idle control valve. This invention is also applicable to the idle speed control for the throttle valve.

As appreciated from the foregoing description of this invention, in controlling the vehicle engine idle speed, the influence of oil temperature and friction can be reliably presumed in accordance with the cumulative time period while the engine operates at a temperature equal to or higher than a predetermined coolant temperature, and accordingly the idle speed can be controlled properly thereby preventing the engine speed reduction and engine stop. In addition, an oil temperature sensor is not needed, alleviating the burden on the apparatus cost.

Further, not only the learnt opening degree but also the correction opening degree are updated so that the influence by the engine oil amount, or by the variation of oil temperature at the engine start, can be eliminated.

Furthermore, the correction opening degree is also used for determining the fixed opening degree of the idle control valve during coasting, thereby preventing a rise in engine speed and fuel consumption.

While the presently preferred embodiments of the present invention have been shown and described, it is to be understood that this disclosure is for the purpose of illustration and that various changes and modifications may be made without departing from the scope of the invention as set forth in the appended claims.

I claim:

1. An idle speed control apparatus of an engine, having valve means for changing an intake air quality to the engine, means for measuring an engine coolant temperature, means for detecting an engine speed, and means responsive to said engine speed for controlling an opening degree of said valve means to maintain said engine speed to a predetermined speed under idling state, comprising:

means for producing a signal when said engine coolant temperature exceeds a predetermined temperature;

means responsive to said signal for starting to count a cumulative time period;

means responsive to said cumulative time period for setting a correction opening degree; and means responsive to said correction opening degree and a current opening degree of said valve means for calculating a learnt opening degree.

2. An apparatus according to claim 1, wherein said correction opening degree setting means operates to reduce said correction opening degree as said cumulative time period becomes long.

3. An apparatus according to claim 1, wherein said correction opening degree setting means operates to setting said correction opening degree to zero when said cumulative time period reaches a predetermined value.

4. An apparatus according to claim 1, wherein said learning means operates to update said learnt opening degree such that a sum of said learnt opening degree and said correction opening degree becomes equal to the current opening degree of said valve means when said learnt opening degree and said sum are lower than said current opening degree.

5. An apparatus according to claim 1, wherein said learning means updates said correction opening degree such that a sum of said learnt opening degree and said correction opening degree becomes equal to said current opening degree of said valve means when said learnt opening degree is lower than said current opening degree and said sum is higher than said current opening degree.

6. An apparatus according to claim 1, wherein said learning means updates said learnt opening degree to said current opening degree of said valve means and updates said correction opening degree to zero when said learnt opening degree is higher than said current opening degree.

7. An apparatus according to claim 1, further comprising:

means responsive to said learnt opening degree and said correction opening degree for determining a fixed opening degree.

* * * * *

UNITED STATES PATENT AND TRADEMARK OFFICE

CERTIFICATE OF CORRECTION

PATENT NO. : 5,002,026

DATED : March 26, 1991

INVENTOR(S) : Hiroya Ohkumo et al.

It is certified that error appears in the above-identified patent and that said Letters Patent is hereby corrected as shown below:

IN THE ABSTRACT [57]:

Line 2 thereof, delete "quality" and insert --quantity--.

Column 1, line 64, delete "quality" and insert --quantity--.

Column 6: Claim 1, line 2, delete "quality" and insert --quantity--.

Signed and Sealed this

Twenty-ninth Day of March, 1994

*Attest:*

*Attesting Officer*

BRUCE LEHMAN

*Commissioner of Patents and Trademarks*